United States Patent [19]

Kunishima

[11] Patent Number: 4,841,642

[45] Date of Patent: Jun. 27, 1989

[54] CUTTER

[75] Inventor: Toshiaki Kunishima, Yokohama, Japan

[73] Assignee: Canon Kabushiki Kaisha, Tokyo, Japan

[21] Appl. No.: 3,627

[22] Filed: Jan. 15, 1987

[30] Foreign Application Priority Data

Jan. 28, 1986 [JP] Japan ..... 61-014845

[51] Int. Cl.[4] ..... B26B 3/00

[52] U.S. Cl. ..... 30/303; 99/537; 30/299

[58] Field of Search ..... 30/299, 301, 302, 303, 30/304, 90.1; 99/537

[56] References Cited

U.S. PATENT DOCUMENTS

| | | | |
|---|---|---|---|
| 2,521,115 | 9/1950 | Calkins | 30/299 X |
| 2,675,580 | 4/1954 | Pesce | 30/299 |
| 3,566,466 | 3/1971 | Matthews | 30/90.1 |

*Primary Examiner*—Frank T. Yost
*Assistant Examiner*—Willmon Fridie, Jr.
*Attorney, Agent, or Firm*—Fitzpatrick, Cella, Harper & Scinto

[57] ABSTRACT

A cutter for cutting an object to be cut has cutting edges for cutting the object to be cut, a holding member for holding the cutting edges, and a guide member for guiding the cutting edges so as to be along the object to be cut when the cutting edges are moved.

8 Claims, 9 Drawing Sheets

CUTTER

BACKGROUND OF THE INVENTION

1. Field of the Invention

This invention relates to a cutter which can cut a wound sheet. More particularly the invention relates to a cutter which can cut a sheet wound, for example, in the form of a roll such as an ink sheet used, for example in a heat transfer recording apparatus, for example, into the form of strips of paper.

2. Related Background Art

The thermosensing transfer recording method has been widely used in recent years because of its general feature that the apparatus used therefor is compact and light in weight as well as free of noise and in addition, because of its capability of recording on plain paper.

The thermosensing recording method uses an ink sheet 5 comprising a base film having thermomelting ink applied thereto, as shown in FIG. 1 of the accompanying drawings, and the inked surface of the ink sheet 5 is superposed on a recording sheet 8 and conveyed by a platen roller 9 and at the same time, it is heated from the base film side thereof by a recording head 10 which generates heat in response to an image signal, and the molten ink is transferred to the recording sheet 8 to thereby accomplish recording, where after the recording sheet 8 is discharged out of the apparatus and the ink sheet 5 is taken up onto a winding core 5*a*.

In the above-described thermosensing recording method, the ink on the ink sheet 5 is transferred from the base film in response to image information and therefore, after the recording, an image portion 11 is clearly left on the ink sheet 5 as shown in FIG. 2 of the accompanying drawings. Accordingly, if the used ink sheet 5 wound on the winding core 5*a* is discarded as it is, secret information may be leaked.

So, heretofore, in order to prevent the record from leaking from the ink sheet 5 after used, it has been contemplated to strip off the ink left on the surface of the ink sheet 5 before the ink sheet 5 is taken up onto the winding core 5*a* after the transfer of the ink, or to chemically treat the ink sheet 5 after taken up onto the winding core 5*a*. Furthermore, it has also been contemplated to boil the ink sheet 5 taken up in the form of a roll to thereby melt the ink left on the base film and make the image information left on the used ink sheet 5 illegible. However, these treating methods have been time-consuming and cumbersome as well as costly.

SUMMARY OF THE INVENTION

It is an object of the present invention to provide a cutter which can simply cut a wound sheet.

It is another object of the present invention to provide a cutter which can cut a sheet wound in the form of a roll into the form of strips of paper.

It is still another object of the present invention to provide a cutter which can simply cut an ink sheet after loaded into a heat transfer recording apparatus and used for the image recording on a recording sheet, to prevent leakage of a secret or secrets.

DESCRIPTION OF THE PREFERRED EMBODIMENTS

Figure 1:
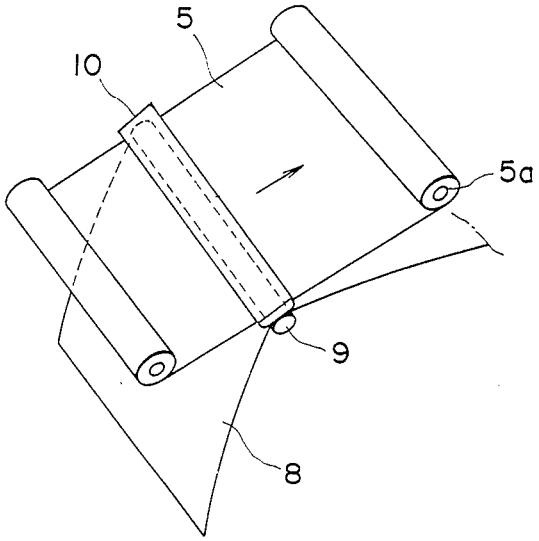
FIG. 1 PRIOR ART
FIG. 1 schematically illustrates the thermosensing transfer recording.
Figure 2:
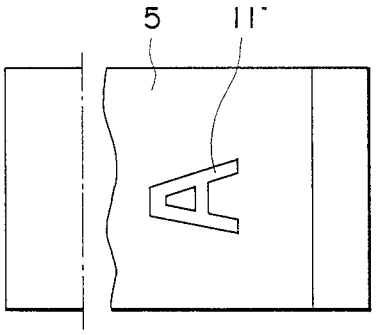
FIG. 2 PRIOR ART
FIG. 2 illustrates an ink sheet after used.
Figure 3:
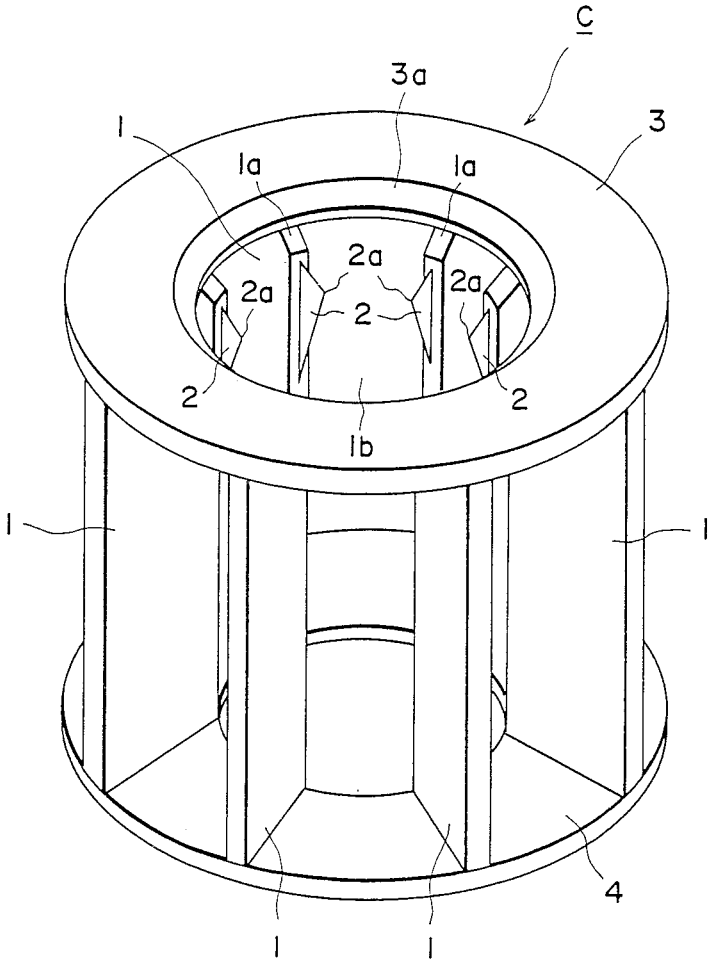
FIG. 3 is a perspective view of a cutter according to an embodiment of the present invention.
Figure 4A:
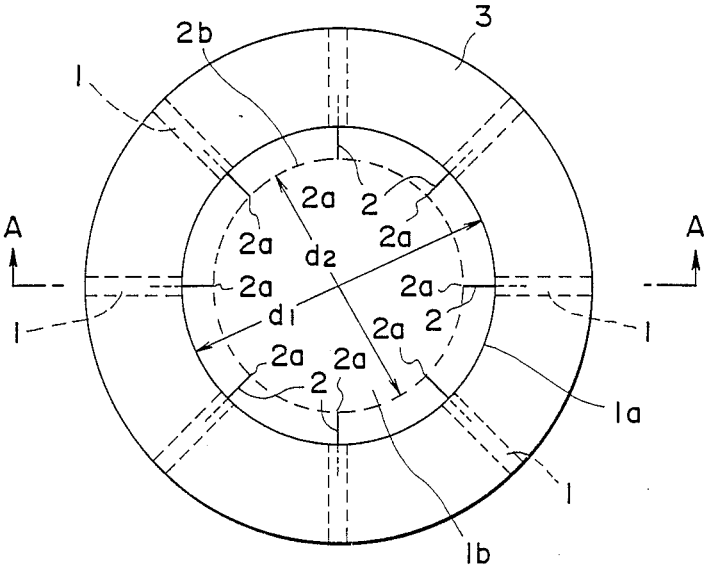
FIG. 4A is a plan view of the FIG. 3 cutter.
Figure 4B:
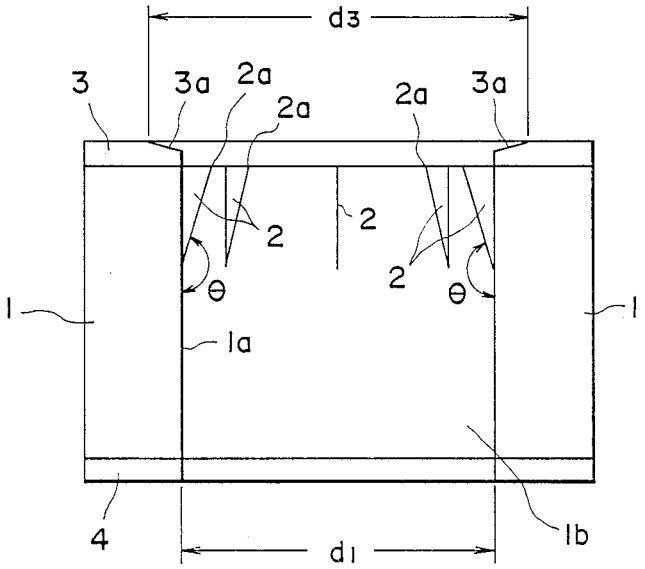
FIG. 4B is a cross-sectional view taken along line A—A of FIG. 4A.

Embodiments hereinafter described are such that cutting edges are provided on the inner surface of a hollow member so that when an article wound in the form of a roll is passed through the hollow member, the article in the form of a roll is cut into the form of strips of paper by the cutting edges. A cutter C to which an embodiment of the present invention is applied will now be described with reference to the drawings. FIG. 3 is a perspective view of a cutter having eight cutting edges in accordance with the present invention, FIG. 4A is a plan view thereof, and FIG. 4B is a cross-sectional view taken along line A—A of FIG. 4A.

Figure 5:
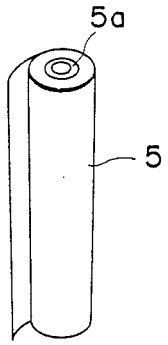
FIG. 5 illustrates an ink sheet wound on a winding core.

In these Figures, reference numeral 1 designates a cutting edge holder for holding cutting edges 2. The upper and lower ends of the cutting edge holders 1 are fixed by an upper ring member 3 and a lower ring member 4 and are arranged in eight equally divided radial directions so that the inner surfaces 1*a* of theholders 1 lie on a circumference, whereby a hollow member is constituted. The diameter $d_1$ of the circumference is somewhat larger than the outside diameter of a roll of ink sheet 5 wound on a winding core 5*a* as shown in FIG. 5.

The cutting edges 2 are attached to the inner surfaces 1*a* of the respective cutting edge holders 1 in such a manner as to be embedded therein and parallel with the axial direction. Each cutting edge 2 is constructed so that the angle $\phi$ thereof with respect to the inner surface 1*a* of each cutting edge holder 1 is an obtuse angle as shown in FIG. 4B, that is, it protrudes gradually inwardly from the lower portion toward the upper portion. The protruding ends 2*a* of the cutting edges 2 are positioned along the circumference of the concentric circle (indicated by broken line 2*b*) with the inner surfaces 1*a* of the holders 1, and the diameter $d_2$ of the concentric circle is substantially equal to the outside diameter of the winding core 5*a* on which the ink sheet 5 is wound.

Further, a tapered portion 3*a* which gradually flares upwardly is formed on the inner peripheral surface of the upper ring member 3, and the inside diameter $d_3$ of the upper end of the inner peripheral surface of the upper ring member 3 is larger than the inside diameter of the lower ring member 4 and the inside diameter $d_1$ of the cutting edge holders 1.

Description will now be made of a case where the ink sheet 5 wound on the winding core 5*a* is cut by the cutter C constructed as described above.

Figure 6A:
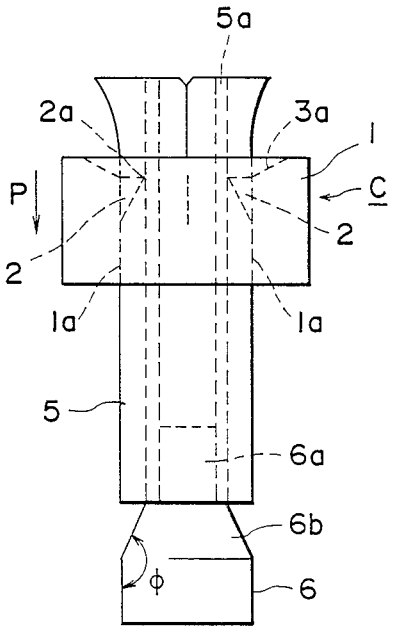
FIGS. 6A and 6B show the cutter as it is used.

The ink sheet 5 is first put erect as shown in FIG. 6A, and when the operator fits the inner surfaces 1*a* of the cutter C into the upper end of the ink sheet and depresses the cutter C along the ink sheet roll 5 with a downward pressure force P, the cutter C moves along the outer periphery of the roll of ink sheet 5 or the outer periphery of the winding core 5*a*. The cutting edges 2 should preferably be provided on the upper portion of the cutting edge holders 1 so that during said movement, the inner surfaces 1*a* of the cutting edge holders 1 serve to guide the cutting edges 2 along the outer periphery of the ink sheet 5. Further, after the cutter has been moved to the lower end of the ink sheet 5 as shown in FIG. 6B, the ink sheet 5 is pulled out upwardly as indicated by arrow a.

When the ink sheet 5 has passed through the hollow portion 1*b* of the cutter C as described above, the ink sheet 5 is cut into eight equal pieces in the circumferential direction of the roll by the eight cutting edges 2 provided radially. When this occurs, the ends 2*a* of the eight cutting edges 2 are coincident with the outside diameter $d_2$ of the winding core 5*a* and therefore, the roll of ink sheet 5 is all cut into strips of paper without leaving any uncut portion.

Figure 6B:
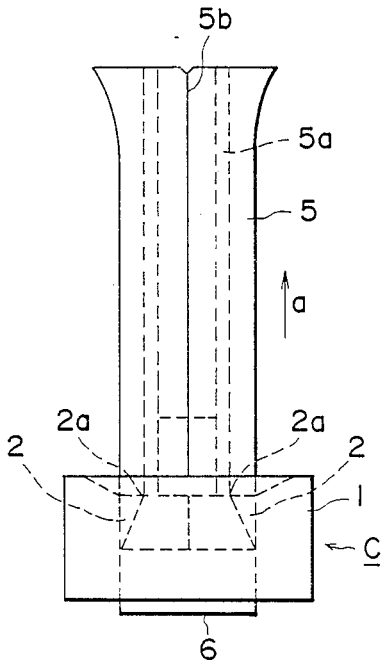

Also, during the cutting, the strips of ink sheet 5 thus cut flare more or less outwardly as shown in FIGS. 6A and 6B, but the upwardly flaring tapered portion 3*a* formed on the inner peripheral surface of the upper ring member 3 prevents the cut ink sheet 5 from clogging in the hollow portion 1*b* of the cutter.

Where the ink sheet 5 is to be cut while being put erect as previously described, a support bed 6 may be fitted to the lower end of the ink sheet 5 as shown in FIGS. 6A and 6B. The support bed 6 is provided with a downwardly flaring frusto-conical portion 6*b* (the angle $\phi$ formed with respect to the vertical line has a relation that $\phi \leqq \theta$) in below the cylindrical portion 6*a* thereof. If the support bed is fitted into the lower end of the ink sheet 5, the protruding ends 2*a* of the cutting edges 2 can be made to reach the lowermost end of the ink sheet 5 when the cutter C is depressed to the lowermost end.

Figure 7:
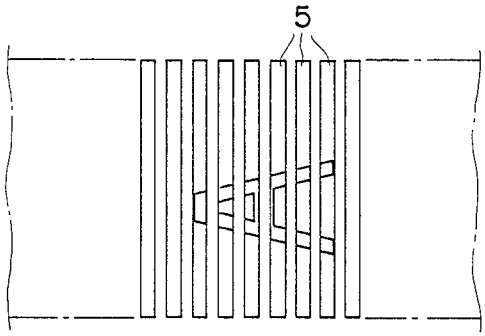
FIG. 7 illustrates an ink sheet cut into strips of paper as it is arranged in order.

FIG. 7 shows a state in which the ink sheet 5 cut into strips of paper is arranged in the form of sheets, and it is seen from this Figure that the image information left on the ink sheet has become illegible. In the above-described embodiment, an example has been shown in which the roll of ink sheet 5 is divided into eight pieces, but when the thickness of the base film of the ink sheet 5 is 6 $\mu$m and the thickness of the ink layer is 3 $\mu$m and the length of the ink sheet 5 is 100 m, the downward pressure force P with which the eight-division cutter is depressed is sufficiently operable even by an operator engaged in ordinary clerical work.

Here, an example of the cutter to which the present invention is applied is shown with specific numerical values.

The inside diameter $d_1$ of the holders 1 (made of an aluminum alloy) is about 53 mm, the length of the inner surfaces 1a thereof is about 60 mm, and the length of the nose 2*a* of the cutting edges 2 (made of stainless steel) is about 9.5 mm. Eight such cutting edges 2 are provided at equal intervals along the inner periphery of the holders 1 at a mounting angle of inclination of about 135 degrees with respect to the inner surfaces 1*a* and at maximum protrusion height of about 9.5 mm.

An ink sheet 5 having the thickness of about 6 $\mu$m of the base film, the thickness of about 3 $\mu$m of the ink layer and a full length of about 100 m and wound in the form of a roll of a diameter of about 52 mm could be cut into strips of paper by the cutter constructed as described above, in the manner as shown in FIG. 4.

Figure 8:
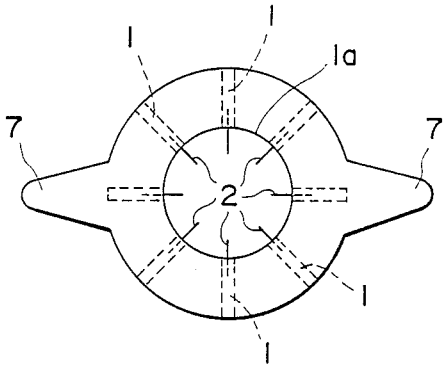
FIG. 8 illustrates a cutter provided with handles.

When the ink sheet 5 is to be cut into strips of paper, eight divisions are not restrictive, but the number of divisions can be changed by changing the number of cutting edges 2. Generally, if the number of divisions is increased, the ink sheet 5 can be cut into a greater number of strips of paper, and this is preferable to prevent leakage of information, but it will require a greater downward pressure force P for the cutter. So, if handles 7 are provided on the cutter C as shown in FIG. 8 so that the operator can grasp the handles 7 to depress the cutter C, the cutter may be easily depressed even if the number of cuts or divisions is increased.

Figure 9:
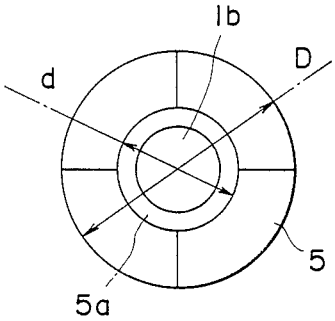
FIG. 9 illustrates the difference between the width of cut near the outer periphery of a roll and the width of cut near the winding core in the case of four divisions.

Also, the cutter may be constructed as shown in FIG. 9 so that the ink sheet may be cut into fine strips of paper with a small downward pressure force P. Here, for the sake of convenience, description is made with respect to the case of four divisions. When a roll of ink sheet was cut by a four-division cutter, the width of the sheet cut into strips of paper is $\pi D/4$ near the outer periphery of the roll and $\pi d/4$ near the winding core 5*a*, as shown in FIG. 9. At this time, $\pi d/4 < \pi D/4$ and therefore, if design is made such that only the vicinity of the outer periphery cut into a greater width can be cut into a smaller width, the ink sheet can generally be cut into narrower strips of paper.

Figure 10:
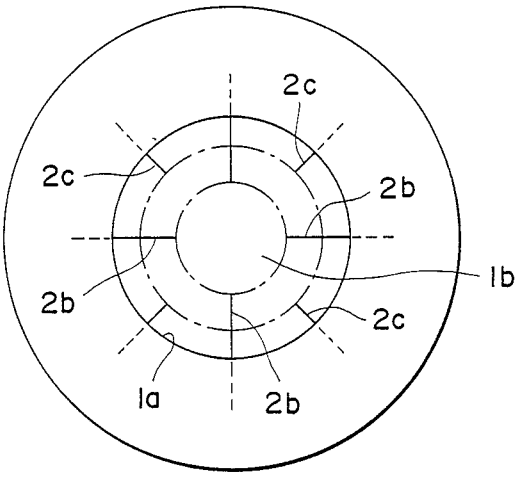
FIG. 10 illustrates an embodiment in which the positions of the protruding ends of cutting edges are changed.

So, when eight cutting edges 2 are to be mounted, if as shown in FIG. 10, cutting edges 2*b* for cutting the ink sheet 5 to the position of the winding core 5*a* and cutting edges 2*c* for cutting the ink sheet 5 to the intermediate portion thereof are alternately arranged along the circumferential direction, the width w of the ink sheet 5 cut into strips of paper will generally be $\pi d/4 \leqq w < \pi D/4$, and in this case, the downward pressure force P may be smaller than in a case where eight cutting edges 2*b* are provided, and the width of the cut strips of paper can be made smaller than in a case where four cutting edges 2*b* are provided.

Figure 11:
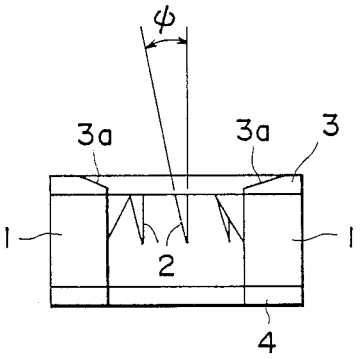
FIG. 11 illustrates are mbodiment in which cutting edges are inclined in the axial direction.
Figure 12:
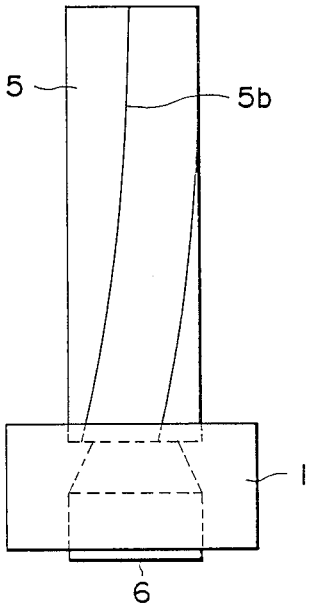
FIG. 12 illustrates a case where cutting is effected by inclined cutting edges.
Figure 13:
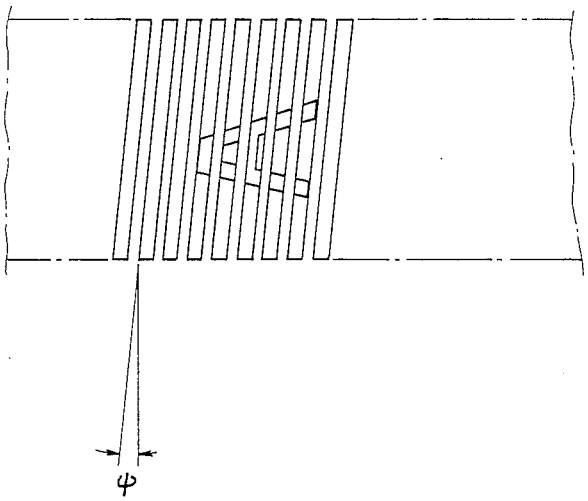
FIG. 13 illustrates an ink sheet cut into strips of paper as it is arranged in order.

Still another embodiment will now be described. In the aforedescribed embodiment, the cutting edges 2 are provided in parallel with to the axial direction of the cutting edge holders 1, whereas in the embodiment shown in FIG. 11, the cutting edges 2 are inclined at an angle $\phi(0° < \phi < 45°)$ with respect to the axial direction of the cutting edge holders 1. With such a construction, when cutting the ink sheet 5, the cutting line 5*b* of the cut ink sheet 5 is made oblique with respect to the axial line by a component of the downward pressure force P, as shown in FIG. 12. Accordingly, even if the ink sheet thus cut into strips of paper is arranged in order, the strips of paper will become inclined by the angle $\phi$ as shown in FIG. 13. If this is done, writings, charts, etc. will become cut in the intermediate portion of each line and thus, will become more illegible than, in the case where the cutting edges 2 are provided in parallel with to the axial direction of the cutting edge holders.

Figure 14A:
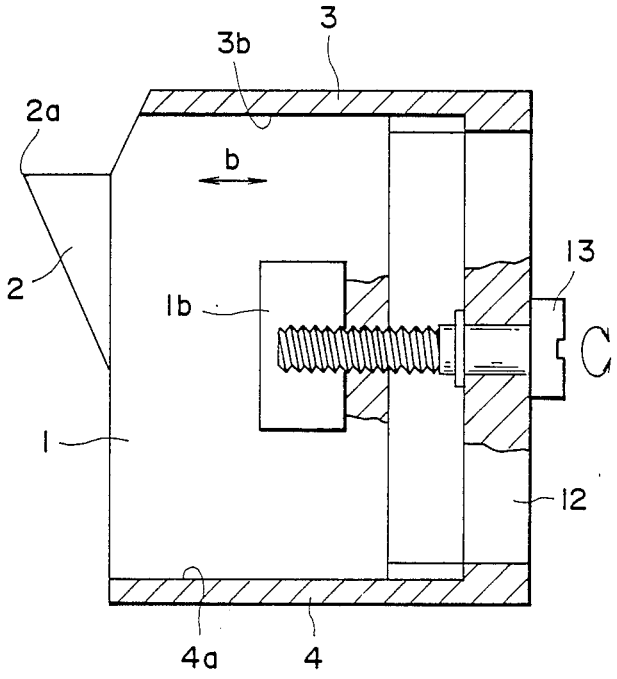
FIGS. 14A, 14B and 14C illustrate an embodiment in which the cutting edges are slidable.
Figure 14B:
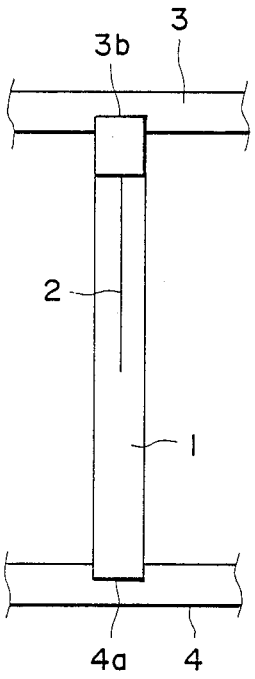
Figure 14C:
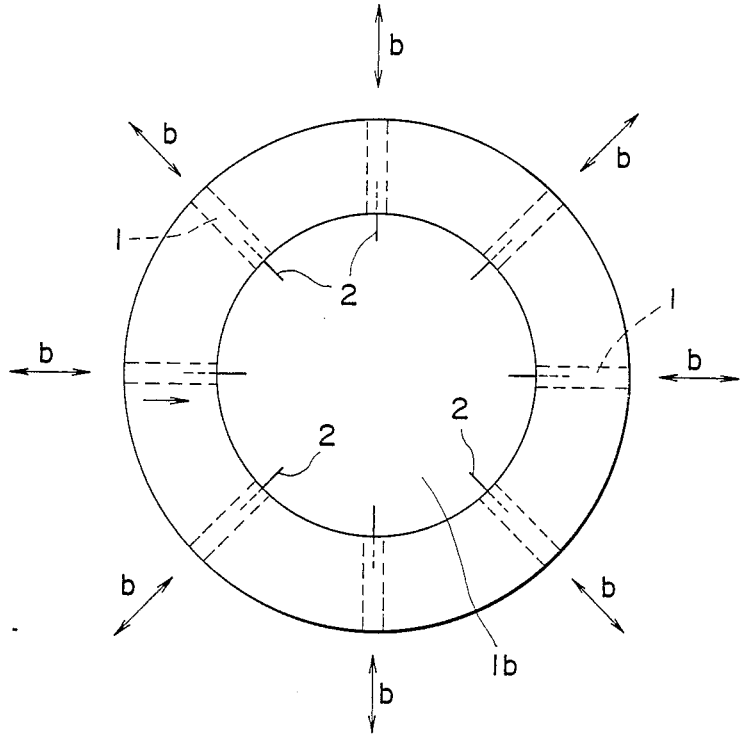

In any of the above-described embodiments, the cutting edges 2 are embedded in the cutting edge holders 1 and thereby secured to the holders, but alternatively, the cutting edges 2 may be slidably constructed. For example, as shown in FIGS. 14A and 14B, the upper ring member 3 and the lower ring member 4 are fixed by a strut 12, slide grooves 3*b* and 4*a* are provided radially of the opposed surfaces of the upper and lower ring members 3 and 4, and the cutting edge holders 1 in which the cutting edges 2 are embedded are slidably mounted along the slide grooves 3*b* and 4*a*. Further, if an adjust screw 13 is rotatably but immovably mounted to the strut 12 and the fore end portion of the adjust screw 13 is designed to be threadably engaged with a nut portion 1*b* embedded in each cutting edge holder 1, the cutting edge holders 1 can be slidden in the directions of bilateral arrows b as shown in FIG. 14C and fixed by rotating the adjust screw 13 clockwise or counter-clockwise. Accordingly, if the outside diameter of the winding core of the ink sheet 5 is changed, the positions of the cutting edges 2 can be adjusted to cut the ink sheet 5 reliably.

The above-described embodiments can cut a roll of sheet into strips of paper by a simple construction in which cutting edges are provided on the inner surface of a hollow member as described above and therefore, can simply make illegible any image information left on an ink sheet wound in the form of a roll, for example, during thermosensing transfer recording, and the operation thereof is simple and not time-consuming and furthermore, such cutter can be manufactured at a low cost.

The above embodiments have been shown with respect to examples in which cutting edges are provided on the inner surface of a hollow member, whereas the present invention is not restricted thereto, but for example, cutting edges may be provided on the outer peripheral surface of a cylinder member to constitute a cutter, and this cutter may be brought into the hollow portion of a roll of cut sheet to cut the roll of sheet from the inside thereof toward the outside thereof. The member for holding the cutting edges is not limited to a cylindrical shape, but may preferable conform to the shape of the object to be cut. For example, if the object to be cut is wound in the shape of a rectangular parallelopiped, the member for holding the cutting edges may be of a rectangular parallelopiped shape. Further, the direction in which a roll of sheet is cut by the cutter is not limited to the direction parallel to the axis of the roll described in the embodiments, but may be a direction perpendicular or oblique to the axis.

As described above, the present invention provides a cutter which can effectively cut a wound sheet.

What is claimed is:

1. A cutter for cutting an object comprising:

a hollow structure having a ring-shaped forward end and a ring-shaped rearward end, with said forward end and said rearward end being in substantially parallel planes with each other, and a plurality of support portions connecting said forward end and rearward end and extending in a plane substantially perpendicular thereto;

a plurality of cutting edges for cutting the object, said cutting edges being supported by said support portions toward said rearward end thereof, and each cutting edge having a first and second side ascending gradually from said support portion to form an inwardly protruding vertex;

a guide portion provided on an inner circumference of said forward end for guiding said cutting edges over the object when said cutting edges cut the object; and an outwardly extending slope portion provided on an inner surface of said rearward end.

2. A cutter according to claim 1, wherein the vertices of said cutting edges are provided so as to cut the object as the cutter is moved downwardly in the direction of cutting.

3. A cutter for cutting a rolled sheet, comprising:

a hollow structure having a ring-shaped forward end and a ring-shaped rearward end, with said forward end and said rearward end being in substantially parallel planes with each other, and a plurality of support portions connecting said forward end and rearward end and extending in a plane substantially perpendicular thereto;

a plurality of cutting edges supported by said supporting portions toward said rearward end thereof to cut the sheet, said cutting edges each having first and second sides ascending gradually from said support portion to form inwardly protruding vertices; and a guide portion provided along an inner circumference of said forward end for guiding said cutting edges in such a manner that said cutting edges move along the sheet when said cutting edges cut the sheet.

4. A cutter according to claim 3, wherein the vertices of said cutting edges are provided so as to cut the object as the cutter is moved downwardly in the direction of cutting.

5. A cutter according to claim 3, wherein the vertices of said cutting edges are disposed on a concentric circle with respect to the inner surface of said hollow structure.

6. A cutter according to claim 3, wherein the inner surface of the rearward end of said hollow member has a flared portion.

7. A cutter according to claim 3, wherein the angle of said cutting edges is obtuse with respect to the inner surface of said hollow structure.

8. A cutter according to claim 3, wherein said cutting edges are inclined with respect to the axial direction of said hollow structure.

* * * * *

UNITED STATES PATENT AND TRADEMARK OFFICE

CERTIFICATE OF CORRECTION

PATENT NO. : 4,841,642

DATED : June 27, 1989

INVENTOR(S) : Toshiaki Kunishima

It is certified that error appears in the above-identified patent and that said Letters Patent is hereby corrected as shown below:

COLUMN 1:

Line 28, "where after" should read --whereafter--.

Line 40, "used," should read --being used,--.

Line 44, "taken up" should read --being taken up--.

Line 61, "loaded" should read --being loaded--.

Line 68, "used." should read --being used.--.

COLUMN 2:

Line 18, "are mbodiment" should read --an embodiment--.

Line 46, "theholders 1" should read --the holders 1--.

COLUMN 3:

Line 45, "in below" should read --below--.

COLUMN 4:

Lines 52 and 68, delete "to".

UNITED STATES PATENT AND TRADEMARK OFFICE

CERTIFICATE OF CORRECTION

PATENT NO. : 4,841,642 Page 2 of 2

DATED : June 27, 1989

INVENTOR(S) : Toshiaki Kunishima

It is certified that error appears in the above-identified patent and that said Letters Patent is hereby corrected as shown below:

COLUMN 5:

Line 16, "slidden" should read --slid--.

Line 43, "preferable," should read --preferably--.

Signed and Sealed this

Second Day of October, 1990

*Attest:*

HARRY F. MANBECK, JR.

*Attesting Officer*

*Commissioner of Patents and Trademarks*